US005261468A

United States Patent [19]

Scheel

[11] Patent Number: 5,261,468

[45] Date of Patent: Nov. 16, 1993

[54] ICE CUBE FUNNEL

[76] Inventor: Eugene E. Scheel, 8446 S.W. 121st St., Miami, Fla. 33156

[21] Appl. No.: 951,781

[22] Filed: Sep. 28, 1992

[51] Int. Cl.[5] ..... B67C 11/00

[52] U.S. Cl. ..... 141/331; 141/332; 141/334; 141/392; 141/98

[58] Field of Search ..... 141/331, 332, 333, 334, 141/340, 311 R, 363-365, 375, 319, 98, 392; 193/2 R, 25 A

[56] References Cited

U.S. PATENT DOCUMENTS

| | | | |
|---|---|---|---|
| 1,039,574 | 9/1912 | Morrill | 141/334 |
| 3,750,722 | 8/1973 | Nowak | 141/332 |
| 4,140,160 | 2/1979 | Glackin | 141/332 |
| 4,237,943 | 12/1990 | Ermel et al. | 141/284 |
| 4,877,155 | 10/1989 | Tull | 141/332 |
| 4,913,201 | 4/1990 | Lucero et al. | 141/334 |
| 5,117,982 | 6/1992 | Schotthafer et al. | 141/331 X |

*Primary Examiner*—Ernest G. Cusick
*Attorney, Agent, or Firm*—AJPV P & T Law Clinic

[57] ABSTRACT

An ice cube funnel which has a combination receptacle and funnel where the ice cube funnel is contemplated to slide onto the lip of an ice tray creating a hood above ice cubes in the ice tray such that the tray may be flipped upside down and pressed to release ice cubes into said hood. The hood includes a funnel portion such that when tilted, directs cubes down a chute and into a receptacle such as a glass.

4 Claims, 1 Drawing Sheet

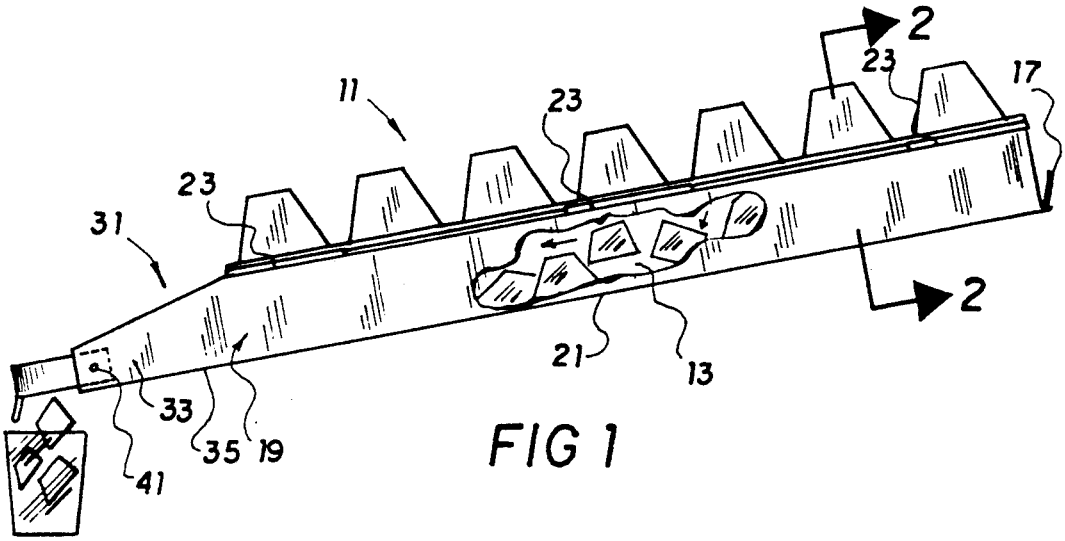
FIG 1
FIG 2
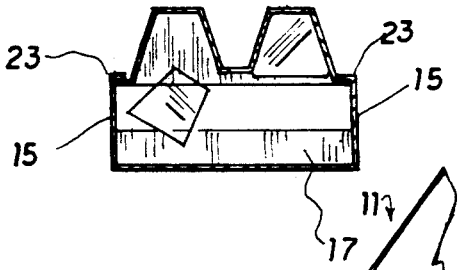
FIG 3
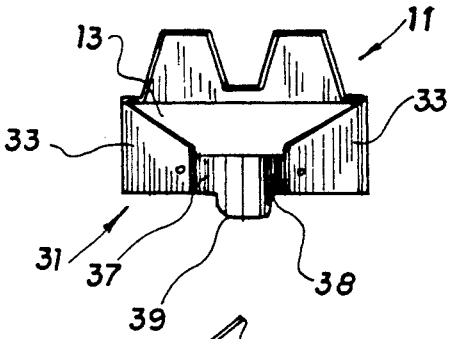
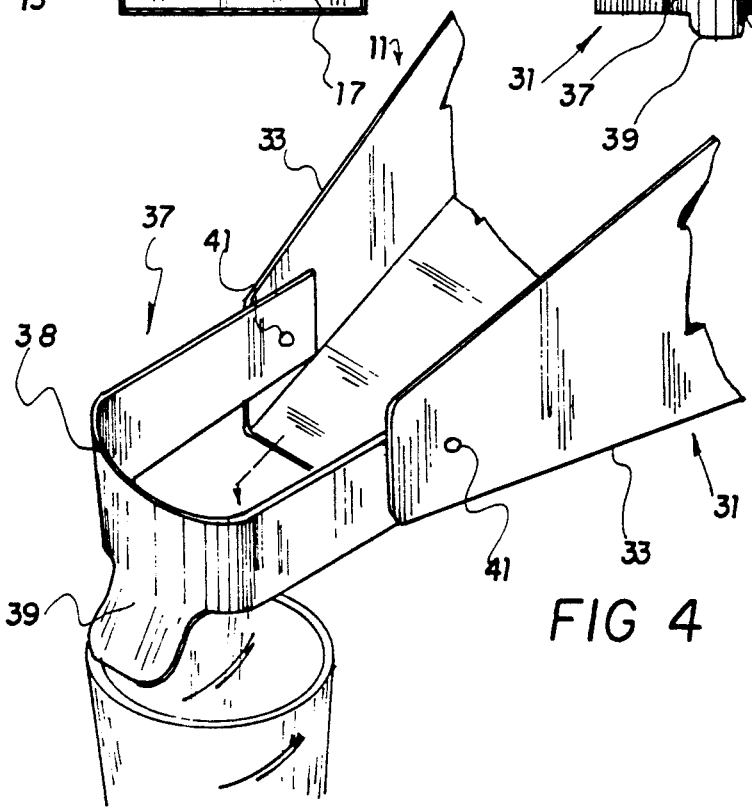
FIG 4

ICE CUBE FUNNEL

BACKGROUND OF THE INVENTION

1. Field of the Invention

This invention relates to an ice cube funnel for holding an ice tray funnelling ice cubes into a glass, pitcher, or container.

2. Description of the Prior Art

In recent years, there have been a number of devices developed for dispensing ice cubes. However, in those cases, the designs have been more in the nature of slidable covers. None of which solve the problem encountered in dropping single ice cubes into a glass.

Accordingly, in order to overcome the above set forth problems of developing a simplified device for funnelling individual ice cubes into a glass or various glasses; and, having the added flexibility of being able to direct the entire contents of a tray of ice into various sized containers.

SUMMARY OF THE INVENTION

The present invention is directed to an ice cube funnel for loosening and directing ice cubes from an ice tray into a glass, pitcher, or container. In addition, the ice cube funnel of the present invention is structured to be easily integrated with current ice trays commonly found at the consumer level.

In operation, the ice cube funnel is contemplated to slide into the lip of an ice tray creating a hood above ice cubes in the ice tray such that the tray may be flipped upside down and pressed to release ice cubes into said hood. Said hood includes a funnel portion such that when tilted, directs cubes down a chute and into a receptacle such as a glass.

Accordingly, it is the principal object of this invention to provide a simplified device which is structured to be utilized in conjunction with standard ice trays as found commonly; requires no secondary ice pouring apparatus; is unobtrusive, space efficient, inexpensive, and easily utilized.

BRIEF DESCRIPTION OF THE DRAWINGS

For a fuller understanding of the nature of the present invention, reference should be had to the following detailed description taken in connection with the accompanying drawings in which:

FIG. 1 is an overhead perspective view of the preferred embodiment of the ice cube funnel of the present invention.

FIG. 2 is a side perspective view of the preferred embodiment of the funnel of the present invention showing the positioning onto the ice tray and the utilization in pouring cubes.

FIGS. 3 and 4 are views of the present invention showing details to the buffer guide and associated structure.

Like reference numerals refer to like parts thoughout several views of the drawings.

DETAILED DESCRIPTION OF THE PREFERRED EMBODIMENT

Referring to the Figures, the preferred embodiment of the present invention is directed toward an ice cube funnel generally indicated as 11 which is designed to hold the edges of an ice tray, create a receptacle 13 for ice, and a chute 31 for directing the pouring of said ice.

The receptacle 13 includes two longitudinal vertical sides 15, a rear wall 17, an open forward section 19, and a bottom 21. Each of said two longitudinal sides 15 includes a grooved edge 23 for for sliding onto a grasping the corresponding longitudinal lips of an ice tray. The rear wall 17 is lower in height than the longitudinal sides 15 in order to accommodate sliding a tray on said grooved edges 23, but of sufficient height to block ice cubes from falling out the rear of said receptacle 13. The forward area 19 opens into said chute 31.

The chute 31 includes two tapering side walls 33 extending from said vertical side 15, a tapering bottom 35 extending from said bottom 21, and a buffer guide 37 for positioning said chute 31 above the lip of a glass, pitcher, or other container.

The buffer guide 37 includes a u-shaped buffer plate 38 extending from and connecting the ends of the chute 31 creating a wall against which ice cubes may be stopped and a downward opening through which said cubes may fall into a container, and, a downwardly extending lip 39 for catching the lip of a container and placement of the opening of said chute 31 for depositing cubes into said container. The buffer guide being connected to the end of said chute 31 by a pin 41 for pivoting said buffer guide 37 away from the mouth of said chute 31 when the user prefers to pour through the chute 31 without the assistance of said buffer guide 37.

It is therefore to be understood that the following claims are intended to cover all of the generic and specific features of the present invention herein described, and all statements of the scope of the invention which as a matter of language, might be said to fall there between.

Now that the invention has been described,

What is claimed is:

1. An ice cube funnel for securing upon the longitudinal lips of an ice tray, said ice cube funnel comprising a receptacle portion;

said receptacle portion including two longitudinal edges;

each of said two longitudinal edges including grasping means for grasping the corresponding longitudinal lips of an ice tray;

said two longitudinal lips of the tray being slidable along said longitudinal edges and within said grasping means;

said receptacle portion including a rearward and forward portion; and, said forward portion comprising an open-ended chute and a mouth, such that ice cubes may be deposited into said receptacle portion and flow out of said mouth.

2. An ice cube funnel as in claim 1, said chute including a buffer guide means for positioning said chute above the lip of a receptacle.

3. An ice cube funnel as in claim 2, said buffer guide means including a downwardly extending lip for catching the lip of a container and placement of said chute for depositing cubes into said container.

4. An ice cube funnel as in claim 2, said buffer guide means including a pivot means for pivoting said buffer guide means away from the mouth of said funnel.

* * * * *